US009475182B2

(12) United States Patent
Ullrich et al.

(10) Patent No.: US 9,475,182 B2
(45) Date of Patent: Oct. 25, 2016

(54) HAND-HELD POWER TOOL WITH MECHANICALLY CONTROLLED AUTOMATIC ON AND OFF FUNCTION

(71) Applicant: Robert Bosch GmbH, Stuttgart (DE)

(72) Inventors: Andre Ullrich, Leinfelden-Echterdingen (DE); Holger Ruebsaamen, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 599 days.

(21) Appl. No.: 13/648,568

(22) Filed: Oct. 10, 2012

(65) Prior Publication Data

US 2013/0092409 A1 Apr. 18, 2013

(30) Foreign Application Priority Data

Oct. 13, 2011 (DE) ..... 10 2011 084 432

(51) Int. Cl.
*B25F 5/00* (2006.01)
*B25B 21/02* (2006.01)

(52) U.S. Cl.
CPC *B25F 5/00* (2013.01); *B25B 21/02* (2013.01)

(58) Field of Classification Search
CPC ..... B25B 21/00; B25B 21/02; B25F 5/02
USPC ..... 173/18, 170
See application file for complete search history.

(56) References Cited

U.S. PATENT DOCUMENTS 3,418,504 A * 12/1968 Paule ..... B23B 45/001 310/43
3,844,360 A * 10/1974 Green ..... B27B 17/0008 173/170

(Continued)

FOREIGN PATENT DOCUMENTS

CN 1356193 A 7/2002
CN 1780587 A 5/2006

(Continued)

*Primary Examiner* — Thanh Truong
*Assistant Examiner* — Patrick Fry
(74) *Attorney, Agent, or Firm* — Maginot, Moore & Beck LLP

(57) ABSTRACT

A hand-held power tool includes a tool housing and a handle housing. The handle housing is movable relative to the tool housing. The hand-held power tool also includes an electric motor for driving the hand-held power tool. The electric motor is switched on and off by a relative movement of the handle housing relative to the tool housing. The hand-held power tool also includes a main electrical switch configured to apply an electrical voltage supply to the electric motor. The main electrical switch is switched by an actuating mechanism. The main electrical switch is actuatable with the aid of a movable component that is movable relative to the tool housing handily via the actuating mechanism, either directly or by the actuating mechanism.

9 Claims, 4 Drawing Sheets

(56) References Cited

U.S. PATENT DOCUMENTS 3,985,188 A * 10/1976 Steele ..... B25C 7/00 173/170
4,265,320 A * 5/1981 Tanaka ..... B25B 23/147 173/178
4,300,282 A * 11/1981 Bunyea ..... H01R 43/015 173/117
4,479,599 A * 10/1984 Conrad ..... B25C 1/18 227/156
5,360,073 A * 11/1994 Akazawa ..... B25B 23/0064 173/15
5,557,990 A * 9/1996 Shin ..... B25B 21/00 81/429
5,701,961 A * 12/1997 Warner ..... B25B 21/00 173/15
5,918,685 A * 7/1999 Ulbrich ..... B23B 49/006 173/15
6,923,268 B2 * 8/2005 Totsu ..... B25B 21/00 173/170
7,740,369 B2 * 6/2010 Gabriel ..... B25B 21/00 362/119
8,636,079 B2 * 1/2014 Totsu ..... B25B 21/00 173/1
2006/0260831 A1 11/2006 Meixner
2008/0266841 A1 10/2008 Gabriel et al.
2009/0308628 A1 * 12/2009 Totsu ..... B25B 21/00 173/176

FOREIGN PATENT DOCUMENTS

CN 102848358 A 1/2013
DE 203 09 492 U1 11/2003
JP 1-257572 A 10/1989

* cited by examiner

HAND-HELD POWER TOOL WITH MECHANICALLY CONTROLLED AUTOMATIC ON AND OFF FUNCTION

This application claims priority under 35 U.S.C. §119 to patent application no. DE 10 2011 084 432.5, filed on Oct. 13, 2011 in Germany, the disclosure of which is incorporated herein by reference in its entirety.

BACKGROUND

The present disclosure relates to a hand-held power tool, in particular a drywall screwdriver, with an electric motor for driving a tool, and with a tool housing and a handle housing, which is provided such that it is movable in relation to the tool housing. The present disclosure also relates to a hand-held power tool particularly according to the disclosure with the tool housing, the electric motor for driving the tool, and a main electrical switch for applying an electrical voltage supply to the electric motor, the main electrical switch being able to be actuated by an actuating mechanism.

Hand-held power tools, in particular drywall screwdrivers, of which the electric motor can be activated with the aid of the pressing force applied by the operator are known. These hand-held power tools have a main electrical switch, which can be handily actuated by an actuating mechanism or actuating mechanism. Moreover, they have a second switch, which is connected parallel to the main electrical switch of the hand-held power tool and with which the electric motor is activated when the pressing force goes above a limiting pressing force and deactivated again when it goes below it. The second switch is in this case actuated contactlessly, for example using optical or magnetic methods, or mechanically, for example using a pushrod.

In principle, virtually all electric tools, in particular rechargeable tools, require an electronic unit, with which the electric motor and/or a battery pack are controlled in order to operate the electric motor. This electronic unit is of varying complexity, and tends to be of a complex configuration gif sensor signals are detected and processed to allow the electric motor to be controlled in dependence on the sensor signals. Such an electronic system usually comprises a microprocessor for processing the sensor signals and for controlling the electric motor.

In comparison with hand-held power tools that merely provide the actuating mechanism for the main electrical switch, the hand-held power tools that have apart from the main switch a second switch in order to activate the electric motor in dependence on the limiting pressing force additionally require at least the parallel-connected second switch and the sensor system required for switching the second switch, along with the control mechanism and/or mechanical components. They are therefore of a comparatively more complex form. Moreover, the second switch and/or the sensor system/mechanical components are often arranged in the handle housing and require installation space there, which however is only available to a limited extent in the handle housing that should be formed as ergonomically as possible.

SUMMARY

The object of the present disclosure is therefore to provide a hand-held power tool, in particular a drywall screwdriver, that can be handled easily by an operator and provides an automatic on and off function, the requirement for components and/or installation space that is necessary for the on and off function, in particular in the handle housing, being minimized as much as possible, and the tool therefore being as simple as possible and able to be produced at low cost.

The object is achieved by a hand-held power tool, in particular a drywall screwdriver, with an electric motor for driving a tool, and with a tool housing and a handle housing, the handle housing being provided such that it is movable in relation to the tool housing, and the electric motor being able to be switched on and off by a relative movement of the handle housing with respect to the tool housing.

According to the disclosure, the hand-held power tool uses the relative movement of the handle housing with respect to the tool housing that is produced for example when the hand-held power tool is pressed against a workpiece for automatically switching the electric motor on and off. The handle housing is in this case preferably provided such that it is axially displaceable and/or rotatable in relation to the tool housing. The hand-held power tool can therefore be operated very easily.

In principle, the switching on of the electric motor with the aid of the relative movement of the handle housing with respect to the tool housing according to the disclosure is also possible by a second switch connected parallel to a main electrical switch. However, it is preferred that a main current flowing from the power source, for example the battery pack, to the electric motor is switched via the relative movement of the handle housing with respect to the tool housing.

In a preferred embodiment, which likewise achieves the object, the hand-held power tool has the electric motor for driving the tool and a main electrical switch for applying an electrical voltage supply to the electric motor, the main electrical switch being able to be actuated by an actuating mechanism, and the hand-held power tool comprising the tool housing, the main electrical switch also being able to be actuated handily by way of the actuating mechanism, and with the aid of a component that is movable in relation to the tool housing either directly or via the actuating mechanism.

Therefore, the main current of the hand-held power tool is switched on and off by the main electrical switch. The hand-held power tool consequently does not require a second switch, but instead the relative movement of the tool housing with respect to the movable component is used to allow either an actuating mechanism, with which an operator can also handily operate the main electrical switch, or the main electrical switch itself to be actuated. This hand-held power tool according to the disclosure is therefore less complex in comparison with a hand-held power tool with a second switch, and consequently can be produced at lower cost. Moreover, fewer components are arranged in the handle housing, so that it can be produced more ergonomically, and therefore such that it is nicer for the operator to handle.

In a first particularly preferred embodiment, the movable component is the handle housing of the hand-held power tool. In this case, the handle housing is preferably mounted rotatably in a direction of rotation about a housing point of rotation on the tool housing, so that, when the hand-held power tool is pressed against a workpiece, it rotates in relation to the tool housing about the housing point of rotation, in particular in the direction of the tool housing. It is likewise preferred for the housing point of rotation to be configured as a bending element.

Furthermore, it is preferred in this embodiment that an operating mechanism is provided on the actuating mechanism and a mating operating mechanism corresponding thereto is provided on the tool housing, said mechanism interacting when there is relative movement of the handle housing with respect to the tool housing, so that the actuating mechanism is actuated.

The actuating mechanism is preferably provided at a distance from the housing point of rotation. As a result, an axial rotation component of the direction of rotation when the hand-held tool housing rotates about the housing point of rotation in the region of the actuating mechanism is greater than a transverse component arranged perpendicularly to the axial rotation component, so that the hand-held tool housing is moved in a virtually axial direction in the region of the actuating mechanism. As a result, the operating mechanism and the mating operating mechanism can be produced with a simple structural configuration.

Furthermore, it is preferred that the handle housing is fastened to the tool housing in the region of the actuating mechanism by a compliant holding element. The holding element is preferably a bellows element. The bellows element is preferably provided in a dust- and moisture-proof manner on the handle housing and on the tool housing, so that the interior space of the hand-held power tool is protected.

The hand-held power tool preferably comprises a spindle, on which the tool can be arranged. The tool is for example a bit holder, into which a screwdriver bit can be inserted.

It is particularly preferred for the spindle to be provided such that it is axially displaceable in relation to the tool housing, from a basic state, in which it cannot be driven, into an operating state, in which it can be driven by the electric motor. A hand-held power tool with such a spindle that cannot be driven in a basic state and can be driven in an operating state is for example a drywall screwdriver.

In a second particularly preferred embodiment, the movable component is the spindle. In this embodiment, the spindle moves in the axial direction when the hand-held power tool is pressed against the workpiece. As a result, the axial displaceability of the spindle that is in any case provided for example in the case of the drywall screwdriver is used for switching the hand-held power tool on and off.

It is preferred that a linkage which is connected to the main electrical switch or the actuating mechanism is provided on the spindle, so that the main electrical switch can be actuated with the aid of the linkage.

It is particularly preferred for the linkage to comprise a pushrod and a switching rod, which are connected to one another, the pushrod also being arranged on the spindle and the switching rod also being arranged on the main electrical switch or on the actuating mechanism. In this case, the pushrod is preferably provided such that it is rotationally decoupled from the spindle, so that it does not rotate along with the spindle when the spindle is being driven. The rotational decoupling preferably takes place with the aid of a spring-loaded ball. Furthermore, it is preferred that the switching rod is mounted rotatably on the main electrical switch, the switch point of rotation being arranged particularly preferably on an axis of the main electrical switch. In the case of this arrangement, the main electrical switch can be switched directly by the switching rod.

In a preferred embodiment, the pushrod and/or the switching rod are produced from a plastic, so that on the one hand they are very lightweight and do not significantly increase the weight of the hand-held power tool and on the other hand they can be produced at low cost. In principle, however, production from some other material is also possible, for example a metal or a metal alloy. It is also preferred for the pushrod and the switching rod to be produced as one part or as more than one part.

It is preferred with reference to all the embodiments mentioned that, when a pressing force goes above a limiting pressing force as a result of the hand-held power tool being pressed against the workpiece, the main electrical switch is actuated and the electrical voltage supply is applied to the electric motor. It is also preferred that, when the pressing force is subsequently reduced and goes below the limiting pressing force, the main electrical switch is once again actuated and the electric motor is disconnected from the electrical voltage supply.

It is also preferred that the actuating mechanism is mounted on the handle housing by a spring, in particular a compression spring. As a result, the actuating mechanism is not moved along at the same time when the main electrical switch is actuated by pressing the hand-held power tool against the workpiece.

The actuation of the main electrical switch directly or with the aid of the actuating mechanism, by the relative movement of the component with respect to the tool housing, can preferably be switched off, in particular by a mode switch. After switching off the automatic on/off function, the hand-held power tool can be switched on and off by pressing the actuating mechanism.

In a preferred embodiment, the hand-held power tool has an electronic unit, which is provided for controlling the electric motor and/or the battery pack. The electronic unit is operated by way of the main current switched by the main electrical switch and is interrupted in order to avoid the hand-held power tool continuing to be operated by way of the electronic unit when there is a short-circuit or defect. It does not require any sensor system with which the movement of the movable component in relation to the tool housing is detected. In this embodiment, if required, the voltage supply is applied to the electric motor by way of the electronic unit.

BRIEF DESCRIPTION OF THE DRAWINGS

The disclosure is described below on the basis of figures. The figures are merely given by way of example and do not restrict the general concept of the disclosure.

DETAILED DESCRIPTION

Figure 1:
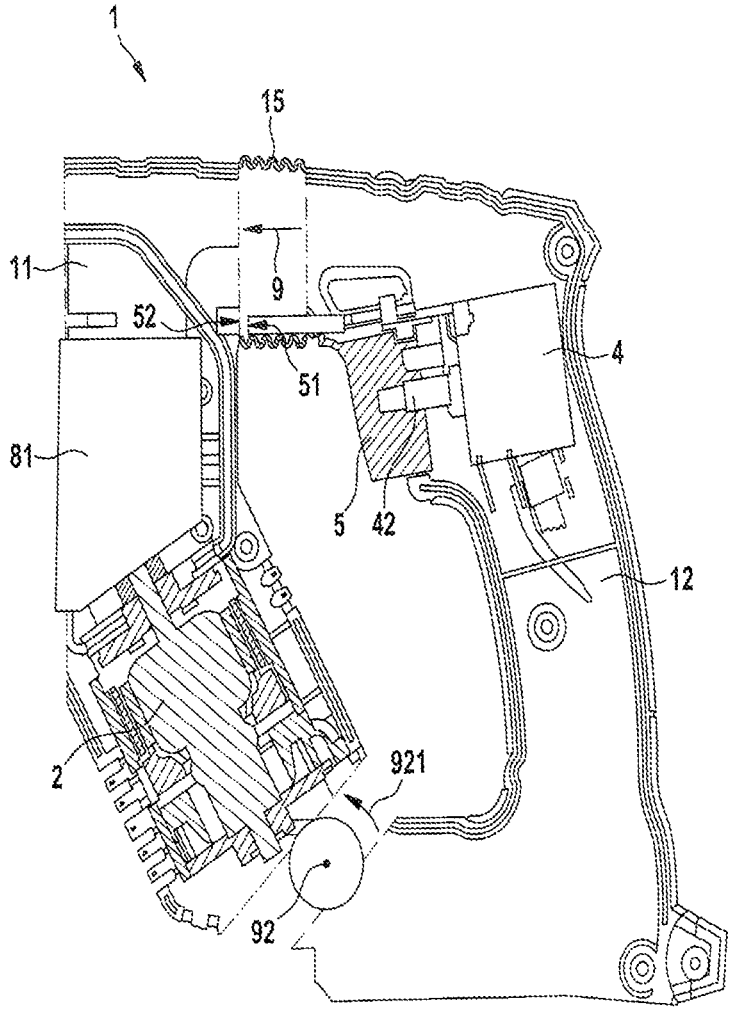
FIG. 1 shows a detail of an embodiment of a hand-held power tool according to the disclosure, the main electrical switch of which can be actuated by a relative movement of a handle housing of the hand-held power tool with respect to a tool housing of the hand-held power tool.

FIG. 1 shows a detail from an embodiment of a hand-held power tool 1 according to the disclosure, the main electrical switch 4 of which is actuated by a relative movement of a handle housing 12 of the hand-held power tool 1 with respect to a tool housing 11 of the hand-held power tool 1. FIG. 1 schematically shows the tool housing 11 and the handle housing 12 of the hand-held power tool 1. Arranged in the handle housing 12 is the main switch 4 and an actuating mechanism 5, with which the main switch 4 is actuated. Arranged in the tool housing 12 is an electric motor 2, with which the hand-held power tool 1 is driven. Also arranged in the tool housing 12 is a spindle 3 (see FIG. 2), which is driven by a gear arrangement 81 when the electric motor 2 is driven.

The main electrical switch 4 is provided for closing a voltage circuit (not shown) for a voltage supply (not shown) of an electric motor 2 driving the hand-held power tool 1 and is arranged in the handle housing 12. It has a switching slide 42, which is actuated by an actuating mechanism 5. The actuating mechanism 5 has an operating mechanism 51, which is formed here as a web and interacts with a mating operating mechanism 52, which is arranged in the tool housing 11. For this, the operating mechanism 51 has at an end facing the mating operating mechanism 52 a contour corresponding to a mating contour of the mating operating mechanism 52.

In the region of the actuating mechanism 5, the handle housing 12 is fastened to the tool housing 11 by a compliant holding element 15, which is configured here as a bellows element. Furthermore, the handle housing 12 is mounted on the tool housing 11 rotatably about a housing point of rotation 92. Moreover, it is axially prestressed by a resilient element (not shown), for example a spring, in order to prevent unintentional activation of the main electrical switch 4.

When the hand-held power tool 1 is pressed in an axial pressing direction 9, the handle housing 12 is pressed against the tool housing 11, so that it rotates in a direction of rotation 921 about the housing point of rotation 92 in relation to the tool housing 11. The housing point of rotation 92 is at a distance from the actuating mechanism 5, so that the operating mechanism 51 is in this case displaced virtually axially in the pressing direction 9, until it comes up against the mating operating mechanism 52. Then, the operating mechanism 51, and consequently the actuating mechanism 5, is pressed counter to the pressing direction 9 and with it the switching slide 42 of the main electrical switch 4 is displaced counter to the pressing direction 9. As a result, the switching slide 42 switches the main electrical switch 4, so that the voltage circuit closes and the electric motor 2 is driven. It is preferred that the actuating mechanism 5 is only displaced counter to the pressing direction 9 when the pressing force goes above the limiting pressing force that is caused for example by a compression spring (not shown). In this embodiment, the relative movement of the handle housing 12 with respect to the tool housing 11 therefore enforces the actuation of the operating mechanism 51. When the hand-held power tool 1 is pressed in the axial pressing direction 9, the handle housing 12 is preferably rotated against a restoring force in relation to the tool housing 11, for example by a spring, so that, when the hand-held power tool 1 is let go, it is rotated back. When it is rotating back, the switching slide 42 and the actuating mechanism 5 are pushed back, so that the main electrical switch 4 is switched again. As a result, the voltage circuit is opened again and the electric motor 2 is no longer driven.

The main electrical switch 4 can also be handily switched by an operator by pressing the actuating mechanism 5.

Such a hand-held power tool 1 is for example a drywall screwdriver, which has a spindle 3 (see FIG. 2), which is axially displaceable in relation to the tool housing 11 and, when the drywall screwdriver 1 is pressed against something, is displaced from a basic state G, in which it cannot be driven, in a pressing direction 9, so that a coupling 131, 132 (see FIG. 2) arranged in the gear arrangement 81 is coupled and the spindle 3 is displaced into an operating state. In the operating state, the spindle 3 and a tool 33 that can be driven by way of the spindle 3 can be driven.

Figure 2A:
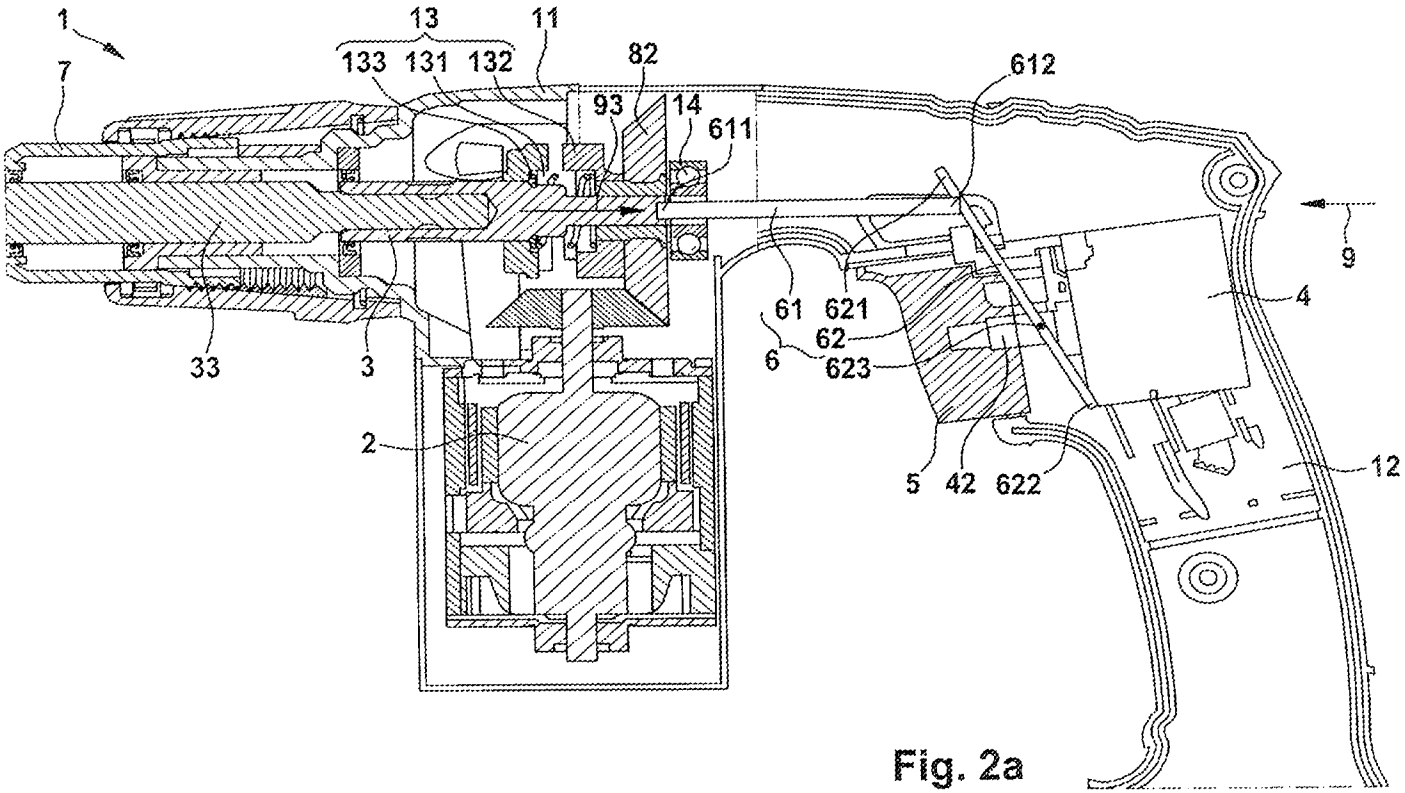
FIG. 2 shows in FIGS. 2(*a*)-(*c*) further embodiments of handheld power tools according to the disclosure, the main electrical switch of which can in each case be actuated by a relative movement of a spindle of the hand-held power tool with respect to the tool housing.
Figure 2B:
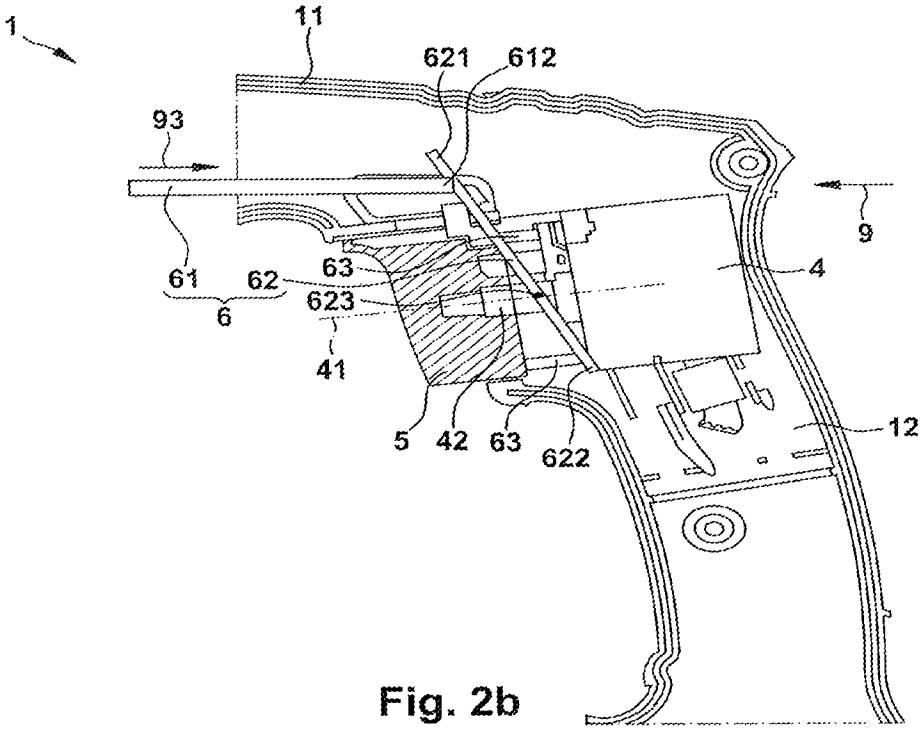
Figure 2C:
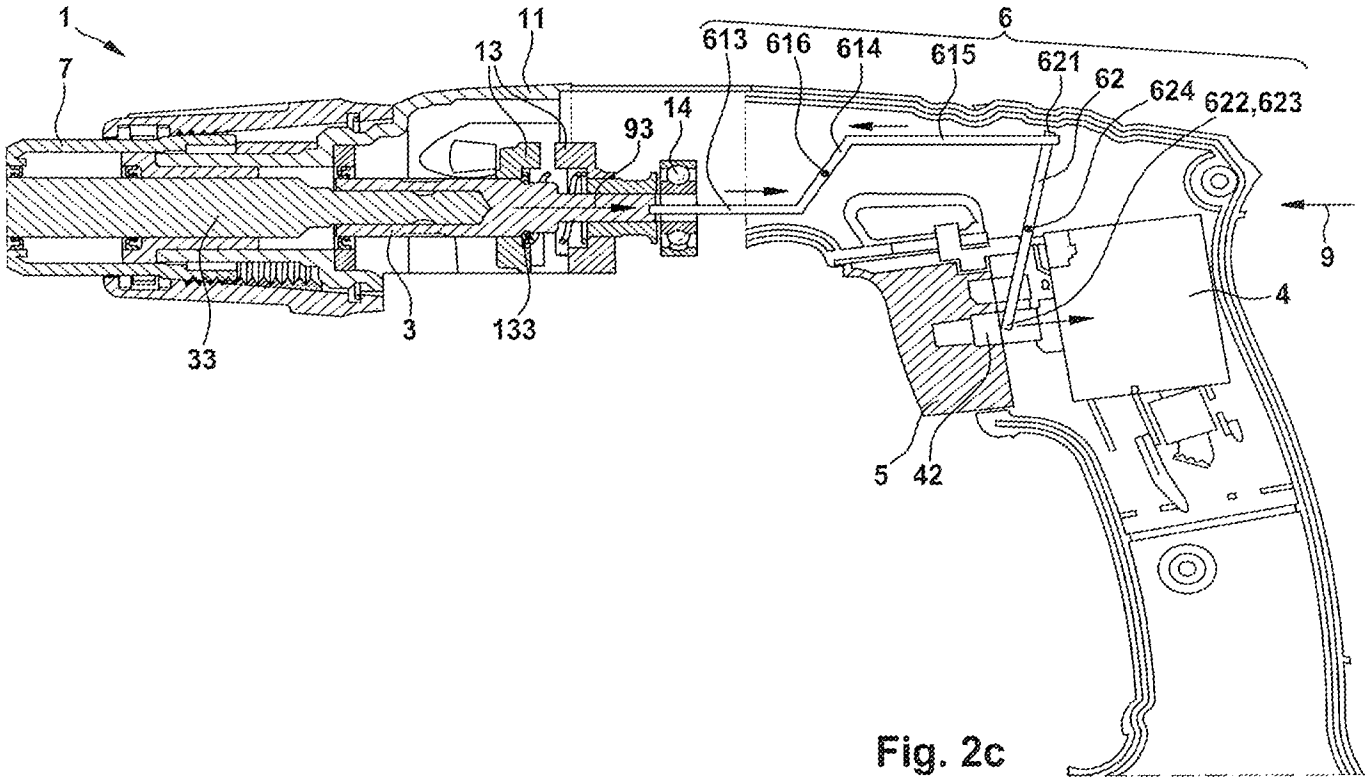

FIG. 2 shows in FIGS. 2(*a*)-(*c*) further embodiments of hand-held power tools 1 according to the disclosure, the main electrical switch 4 of which can in each case be actuated by a relative movement of a spindle 3 of the hand-held power tool 1 with respect to the tool housing 11. The spindle 3 is mounted rotatably in the tool housing 11 by a bearing 14 and is intended for driving a tool 33. The tool is for example a bit holder for receiving a screwdriver bit. In FIGS. 2(*a*) and (*b*) there can be seen a depth stop 7, which limits a screwing-in depth of a screw inserted into the screwdriver bit. The spindle 3 can be driven by way of the electric motor 2 with the aid of a bevel wheel 82.

The embodiments show in each case a drywall screwdriver, in which the spindle 3 is provided such that it is axially displaceable in relation to the tool housing 11, from a basic state G, in which it cannot be driven, into an operating state B, in which it can be driven by the electric motor 2. In the embodiments shown, the spindle is in the basic state G. In the following, the terms drywall screwdriver and hand-held power tool 1 are used synonymously.

Each of the drywall screwdrivers 1 has for this in each case a coupling 13, which comprises two coupling parts 131, 132. When the drywall screwdriver 1 is pressed against a workpiece in the pressing direction 9, the spindle 3 is displaced with the coupling part 131, which is facing the tool, counter to the pressing direction 9 in a displacing direction 93 and comes into engagement with the coupling part 132, which is facing away from the tool, so that the coupling parts 131, 132 interact in a torque-transmitting manner in the operating state B.

For switching on the hand-held power tool 1, it also has a linkage 6, which comprises a switching rod 62, which is arranged on the switching slide 42 of the main electrical switch 4.

In the embodiments of FIG. 2(*a*) and FIG. 2(*b*), the switching rod 62 has a first end 621, which is arranged rotatably at a second end 612 of the pushrod 61, and a second end 622, which is arranged rotatably on the handle housing 12 and/or on the electrical switch 4. Furthermore, the switching rod 62 is rotatable about a switch point of rotation 623, which is arranged on the axis 41 (shown in FIG. 2(*b*)) of the switching slide 42.

The pushrod 61 is arranged with a first end 611 on the spindle 3, particularly in a rotationally decoupled manner, and, when the spindle 3 is displaced counter to the pressing direction 9, is likewise displaced counter to the pressing direction 9, so that the switching rod 62 rotates about its second end 622. In this case, the switching slide 42 is displaced counter to the pressing direction 9, so that the main electrical switch 4 is actuated. In these embodiments, the relative movement of the spindle 3 with respect to the tool housing 11 therefore enforces the actuation of the pushrod 61.

When the drywall screwdriver 1 is pressed against something, therefore, not only is the spindle 3 displaced from the basic state G into the operating state B, but at the same time the main electrical switch 4 is pressed. The main electrical switch 4 can, however, also be handily switched by the operator, in that said operator actuates the actuating mechanism 5 arranged axially displaceably on the switching slide 42.

The embodiments of FIG. 2(*a*) and FIG. 2(*b*) differ in that the actuating mechanism 5 of FIG. 2(*b*) is supported by two compression springs 63 on the main electrical switch 4 and/or the handle housing 12, so that, when the main electrical switch 4 is actuated, it is not displaced counter to the pressing direction 9 together with the switching slide 42 by the relative movement of the spindle 3 with respect to the tool housing 11. In this case, the second end 622 of the switching rod 62 is supported on a housing of the main electrical switch 4.

By contrast with the embodiments of FIG. 2(*a*) and FIG. 2(*b*), the embodiment of FIG. 2(*c*) has instead of a single pushrod 61 a pressing lever mechanism with a first pushrod 613, a second pushrod 614 and a third pushrod 615, which are arranged so as to make a transmission possible. As a result, a displacing path of the spindle 3 and of the first pushrod 613, which is arranged on the spindle 3, is less than an actuating path of the switching slide 42 when the spindle 3 is displaced counter to the pressing direction 9 when the hand-held power tool 1 is pressed against the workpiece.

For this, the first and third pushrods 613, 615 are in each case rotatably fixed at opposite ends of the second pushrod 612, which is mounted rotatably about a point of rotation 616. The third pushrod 615 is also connected to the first end 621 of the switching rod 62. The switching rod 62 is arranged with its second end 622 rotatably on the switching slide 42 and mounted rotatably about a point of rotation 624, which here is provided approximately in the middle of the switching rod 62. When the spindle 3 is displaced counter to the pressing direction 9, the first pushrod 613 is therefore likewise displaced counter to the pressing direction 9, so that the second pushrod 614 rotates about its point of rotation 616 and the third pushrod 615 is displaced in the pressing direction 9. As a result, the switching rod 62 is rotated about its point of rotation 624 and the switching slide 42 is displaced with the second end 622 of the switching rod 62 counter to the pressing direction 9, so that the main electrical switch 4 is actuated. In this embodiment, the relative movement of the spindle 3 with respect to the tool housing 11 therefore enforces the actuation of the first pushrod 613.

Also in this embodiment, the main electrical switch 4 can be handily switched by the operator, in that said operator actuates the actuating mechanism 5 arranged on the switching slide 42.

The coupling 13 of the drywall screwdriver 1 of FIGS. 2(*a*)-(*c*) has a spring 133, by which the coupling parts 131, 132 are spaced apart from one another in the basic state of the spindle 3. The spindle 3 is therefore adjusted from the basic state G into the operating state B counter to a restoring force of the spring 133. When the pressing force goes below the limiting pressing force, the spindle 3 is displaced in the pressing direction 9 and the coupling parts 131, 132 disengage. At the same time, the pushrod 61 or the first pushrod 613 is displaced with the spindle 3 in the pressing direction 9, so that the switching rod 62 rotates back and the switching slide 42 is displaced back in the pressing direction 9. As a result, the main electrical switch 4 is switched and the voltage circuit is opened, so that the electric motor 2 is no longer driven.

What is claimed is:

1. A hand-held power tool comprising:

a housing;

an electric motor positioned in the housing and configured to drive a tool about a drive axis;

a main electrical switch configured to selectively electrically connect an electrical voltage supply to the electric motor;

an actuating mechanism located partially exterior to the housing and configured to actuate the main electrical switch when pressed by an operator of the hand-held power tool; and a movable component configured to secure the tool and further configured to be moved axially along the drive axis to actuate the main electrical switch; and a linkage coupled to the movable component and configured to actuate the main electrical switch directly or via the actuating mechanism, wherein the movable component is a spindle that is configured to be driven to rotate about the drive axis by the electric motor, wherein the linkage comprises a pushrod connected to a switching rod, wherein the pushrod is directly connected to the spindle, and wherein the switching rod is directly connected to the main electrical switch or via the actuating mechanism.

2. The hand-held power tool of claim 1, wherein the spindle is axially movable along the drive axis, the spindle being axially movable from a basic state, in which the spindle is not drivable, to an operating state, in which the spindle is drivable by the electric motor.

3. The hand-held power tool of claim 1, wherein the pushrod is rotationally decoupled from the spindle.

4. The hand-held power tool of claim 1, wherein at least one of the pushrod and the switching rod is produced from a plastic.

5. The hand-held power tool of claim 1, wherein the switching rod is mounted rotatably about a switch point of rotation on an axis of the main electrical switch.

6. A hand-held power tool comprising:

a housing;

an electric motor positioned in the housing and configured to drive a tool about a drive axis;

a main electrical switch configured to selectively electrically connect an electrical voltage supply to the electric motor;

an actuating mechanism accessible from outside of the housing and configured to actuate the main electrical switch; and a movable component configured to secure the tool and further configured to be moved axially along the drive axis to actuate the main electrical switch, wherein the movable component is a spindle configured to secure the tool, wherein a linkage is coupled to the spindle and is configured to actuate the main electrical switch directly or via the actuating mechanism, and wherein:

the linkage comprises a pushrod connected to a switching rod;

the pushrod is directly connected to the spindle, and the switching rod is directly connected to the main electrical switch or via the actuating mechanism.

7. The hand-held power tool of claim 6, wherein the pushrod is rotationally decoupled from the spindle.

8. The hand-held power tool of claim 6, wherein at least one of the pushrod and the switching rod is produced from a plastic.

9. The hand-held power tool of claim 6, wherein the switching rod is mounted rotatably about a switch point of rotation on an axis of the main electrical switch.

* * * * *